United States Patent [19]

Wiley et al.

[11] Patent Number: 4,929,120

[45] Date of Patent: May 29, 1990

[54] TWO STAGE PROCESS FOR REJUVENATING ASPHALT-PAVED ROAD SURFACES

[75] Inventors: Patrick C. Wiley, Williams Lake; Allen H. Rorison, Kamloops, both of Canada

[73] Assignee: 373249 B.C. Ltd., Vancouver, Canada

[21] Appl. No.: 183,682

[22] Filed: Apr. 19, 1988

[30] Foreign Application Priority Data

Feb. 26, 1988 [CA] Canada ..... 559989

[51] Int. Cl.[5] ..... E01C 23/14

[52] U.S. Cl. ..... 404/77; 404/79

[58] Field of Search ..... 404/77, 79, 82, 75, 404/90–92, 95; 126/271.2 A

[56] References Cited

U.S. PATENT DOCUMENTS

| | | | |
|---|---|---|---|
| 3,807,886 | 4/1974 | Cutler | 404/77 |
| 3,843,274 | 10/1974 | Gutman et al. | 404/91 |
| 3,874,366 | 4/1975 | Cutler | 126/271.2 A |
| 3,970,404 | 7/1976 | Benedetti | 404/77 |
| 3,997,276 | 12/1976 | Jackson, Sr. | 404/77 |
| 4,129,398 | 12/1978 | Schoelkopf | 404/95 |
| 4,186,968 | 2/1980 | Barton | 299/39 |
| 4,226,552 | 10/1980 | Moench | 404/92 |
| 4,335,975 | 6/1982 | Schoelkopf | 404/77 |
| 4,534,674 | 8/1985 | Cutler | 404/75 |
| 4,545,700 | 10/1985 | Yates | 404/75 |
| 4,711,600 | 12/1987 | Yates | 404/95 |
| 4,784,518 | 11/1988 | Cutler | 404/79 |
| 4,850,740 | 7/1989 | Wiley | 404/79 |

OTHER PUBLICATIONS

Yates Corporation brochure, "The World's First Practical & Efficient Asphalt Pavement Surface Restoration Process . . . ", 1987.

"South Carolina Road Gets 100% Recycle", Asphalt '87.

"Cutler Big Paver"; 15 Oct. 1985, Brochure of Cutler Repaving Inc., Lawrence, KS.

"Guideline Specifications for Hot Surface Recycling"; Jul., 1986, Publication of Asphalt Reclaiming & Recycling Assoc., Annapolis, Md.

"Remixer 4500"; undated brochure on Wirtgen GmbH, West Germany.

"Hot In-Place Recycling Heat Reforming Process"; undated brochure of Taisei Rotec, Inc., Woodinville, WI.

"Cutler Repaving Inc."; Sep., 1983, brochure of Cutler Repaving Inc., Lawrence, KS.

*Primary Examiner*—Jerome W. Massie, IV
*Assistant Examiner*—Matthew Smith
*Attorney, Agent, or Firm*—Barrigar & Oyen

[57] ABSTRACT

An asphalt-paved road surface is rejuvenated in two stages. First, an exposed upper asphalt layer is heated to a selected temperature and depth. The heated upper asphalt layer is then removed from the road surface to expose a lower asphalt layer. In the second stage of the process, the lower asphalt layer is heated to a selected temperature and depth. The lower layer is then either broken up and left in place, or else it too is removed from the road surface. In the former case, asphalt removed from the upper layer is replaced on top of the ruptured lower layer; in the latter case, asphalt removed from the upper layer is comingled with asphalt removed from the lower layer. The removed/ruptured or comingled asphalt (as the case may be) is then pressed back against the road surface to repave the road.

8 Claims, 1 Drawing Sheet

TWO STAGE PROCESS FOR REJUVENATING ASPHALT-PAVED ROAD SURFACES

FIELD OF THE INVENTION

This application pertains to a process for rejuvenating asphalt-paved road surfaces. The first process stage involves heating an upper asphalt layer to a selected temperature and depth and then removing that layer from the road surface to expose a lower layer of asphalt. In the second stage of the process the lower asphalt layer is heated to a selected temperature and depth. The lower layer is then either broken up and left in place, or else it too is removed from the road surface. In the former case, asphalt removed from the upper layer is replaced on top of the ruptured lower layer; in the latter case, asphalt removed from the upper layer is comingled with asphalt removed from the lower layer. The removed/ruptured or comingled asphalt (as the case may be) is then pressed back against the road surface to repave the road.

BACKGROUND OF THE INVENTION

Asphalt-paved road surfaces are subject to deterioration caused by a number of factors. For example, seasonal temperature fluctuations cause the road surface to become brittle and/or cracked. Erosion of the road bed beneath the road surface may also result in cracking. Moreover, certain of the chemical constituents incorporated in fresh asphalt are gradually lost or their properties change with time, further contributing to brittleness and/or cracking of the road surface.

The prior art has evolved a variety of techniques for rejuvenating asphalt-paved road surfaces. Most prior art processes involve the use of large banks of heaters which heat the road surface to a temperature in the 240°-350° F. range to a depth of about 1-2 inches. Such heating softens the upper, exposed layer of asphalt which can then be broken up with conventional mechanical grinders or scarifiers. Typically, a small amount of fresh asphalt or asphalt rejuvenant is mixed with the heated, broken asphalt and this mixture is then distributed over the road surface and pressed back into position to leave a smooth, finished road surface. In some cases, the heated, broken material is removed altogether from the road surface, mixed with fresh asphalt or asphalt rejuvenant material and then returned to the road surface and pressed back into position.

The prior art is exemplified by U.S. Pat. No. 3,807,886 issued 30 Apr., 1974 for an invention of Earl F. Cutler entitled "Method for Heating Asphalt Concrete Roadways and the Like"; U.S. Pat. No. 3,843,274 issued 22 Oct., 1974 for an invention of Nathan Gutman et al entitled "Asphalt Reclaimer"; U.S. Pat. No. 3,874,366 issued 1 Apr., 1975 for an invention of Earl F. Cutler entitled "Exhaust Manifold for Asphalt Concrete Heating Apparatus"; U.S. Pat. No. 3,970,404 issued 20 Jul., 1976 for an invention of Angelo W. Benedetti entitled "Method of Reconstructing Asphalt Pavement"; U.S. Pat. No. 3,997,276 issued 14 Dec., 1976 for an invention of James A. Jackson, Sr. entitled "Road Maintenance Machine and Methods"; U.S. Pat. No. 4,129,398 issued 12 Dec., 1978 for an invention of Walter Schoelkopf entitled "Method and Apparatus for Plastifying and Tearing Up of Damaged Road Surfaces and Covers"; U.S. Pat. No. 4,335,975 issued 22 Jun., 1982 for a further invention of Walter Schoelkopf having the same title; U.S. Pat. No. 4,226,552 issued 7 Oct., 1980 for an invention of Frank F. Moench entitled "Asphaltic Pavement Treating Apparatus and Method"; and, U.S. Pat. No. 4,534,674 issued 13 Aug., 1985 for an invention of Earl F. Cutler entitled "Dual Lift Repaving Machine".

The inventors consider the prior art techniques aforesaid to be undesirable because they are incapable of heating the asphalt road surface to an adequate depth without risking irreversible damage to the asphalt material through application of excessive heat, or without extending the time required for the process to the point that it becomes uneconomical. More particularly, the inventors believe that in order to adequately rejuvenate an asphalt-paved road surface, at least 2 inches of asphalt material must be removed from the road surface, mixed with fresh asphalt or an asphalt rejuvenant agent (depending upon the extent to which the existing asphalt has deteriorated), and then returned to the road surface (this of course assumes that the existing road surface has not deteriorated so badly that it must be replaced in its entirety).

Most roads are paved with asphalt to a minimum depth of about 3 inches. If the road surface is cracked, then asphalt must be removed to a depth of at least ⅔ of the crack penetration depth or else the crack will quickly reappear after the road surface is rejuvenated in accordance with prior art techniques like those described above. Unfortunately however, these state-of-the-art processes permit asphalt to be removed from the road surface to a depth of only about 1 inch. It can thus be seen that if a 3 inch road surface has a crack which extends completely through the road surface then it will not be possible, with the prior art techniques, to remove material from the road surface to a depth of ⅔ of the crack penetration depth (i.e. 2 inches) and so the crack will likely quickly reappear if the road is resurfaced in conventional fashion.

It takes approximately 4 times as long to heat an asphalt road surface to a depth of about 2 inches as is required to heat the same road surface to the same temperature and to a depth of about 1 inch. It can thus be seen that it would take approximately 4 times as long for prior art techniques like those mentioned above to heat an asphalt road surface to the 2 inch depth preferred by the inventors in order to facilitate removal of asphalt from the road surface to a depth of 2 inches. Moreover, in order to achieve a 2 inch heat penetration depth by conventional methods, excessive heat would have to be applied to the exposed upper asphalt surface. Preferably, asphalt should not be heated to a temperature above about 300° F.-325° F. or else the asphalt's constituent oils may be burned off, resulting in brittleness of the asphalt material which can in turn lead to severe cracking problems, especially during the winter season.

The inventors have devised a technique in which an asphalt-paved road surface is rejuvenated in two stages. The inventors' technique facilitates heating of the asphalt to the desired 2 inch depth without risking damage of the asphalt material through application of excessive heat thereto and also without significantly extending the time required to complete the road resurfacing process.

SUMMARY OF THE INVENTION

In accordance with the preferred embodiment, the invention provides a method of rejuvenating an asphalt-paved road surface. An exposed upper layer of asphalt is first heated to a selected temperature and depth (preferably about 300° F. and one inch respectively). The heated upper asphalt layer is then removed from the road surface to expose a lower asphalt layer. The lower layer is then heated to a selected temperature and depth (again, preferably about 300° F. and one inch respectively). The heated lower asphalt layer is then either broken up (i.e. ruptured), but otherwise left in place on the road surface, or else it too is removed from the road surface. If the lower layer is merely ruptured, then asphalt previously removed from the upper layer is replaced on top of the ruptured lower layer. If the lower layer is removed, then asphalt removed from the upper and lower layers is comingled and returned to the road surface. Finally, pressure is applied to force the replaced/ruptured or comingled asphalt material (as the case may be) back against the road surface, thereby repaving the road. If desired, fresh asphalt or an asphalt rejuvenant may be added to the asphalt before it is pressed back into place on the road surface.

DETAILED DESCRIPTION OF THE PREFERRED EMBODIMENT

Figure 1:
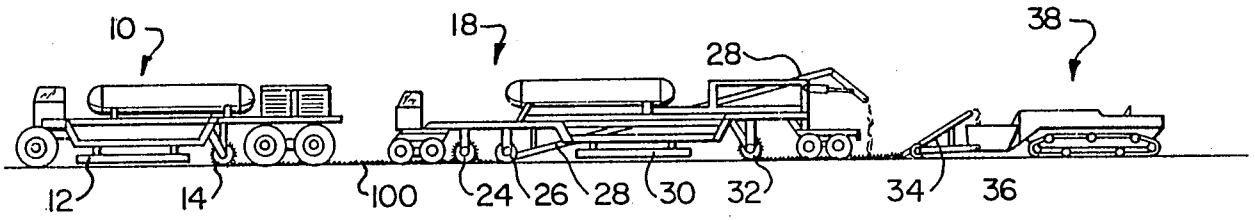
FIG. 1 is a schematic illustration depicting a series of machines employed to rejuvenate an asphalt-paved road surface in accordance with the preferred embodiment of the invention.
Figure 2:
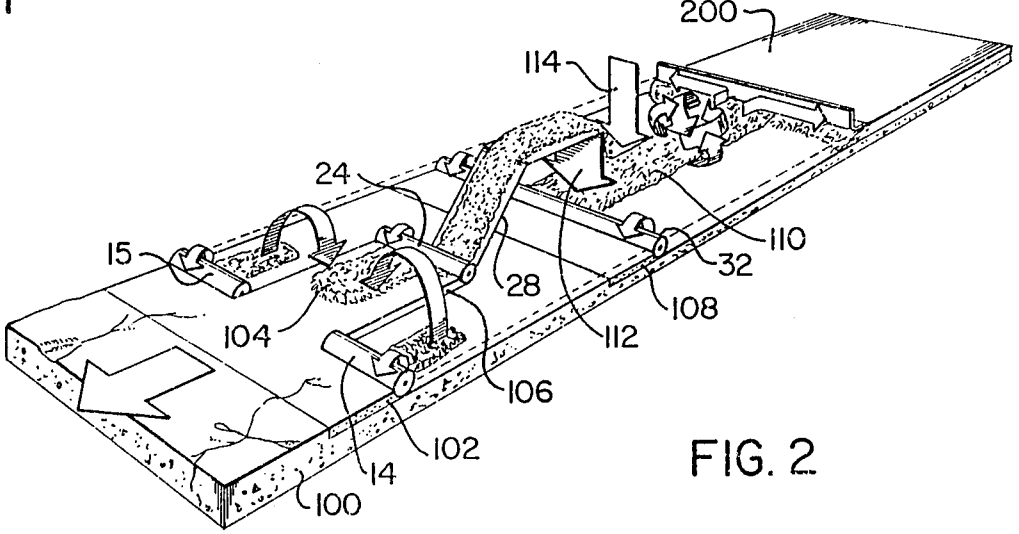
FIG. 2 is a pictorial illustration depicting the sequence of steps employed in practising the invention according to its preferred embodiment.

FIG. 1 depicts a series of machines which may be employed to rejuvenate an asphalt-paved road surface 100 in accordance with the invention. FIG. 2 depicts the sequence of steps employed. For clarity of illustration, portions of the machines depicted in FIG. 1 are shown diagrammatically in FIG. 2.

Self-propelled machine 10 is equipped with a bank of underslung propane-fired infrared heaters 12 which may be lowered to within a few inches of road surface 100. Machine 10 is driven along a section of road surface 100 which is to be rejuvenated at a speed of about 20 to 25 feet per minute to heat the exposed upper layer 102 (FIG. 2) of road surface 100 to a temperature of about 300° F. and to a depth of about one inch. A pair of axially aligned grinders 14, 15 (only one of which; namely grinder 14, is visible in FIG. 1) are mounted at the rear end of machine 10. Grinders 14, 15 remove outer strips of heated upper asphalt layer 102 from road surface 100 and windrow the removed material into a pile 104 which is left on top of central strip 106 of upper layer 102.

A second, self-propelled machine 18 follows behind machine 10. Grinder 24 mounted at the forward end of machine 18 and centered with respect to the longitudinal path along which the train of equipment is driven, grinds away the upper inch of hot asphalt; namely central strip 106 which is left in place between grinders 14, 15 by machine 10. Screw feed mechanism 26 (depicted only in FIG. 1) mounted behind grinder 24 feeds the asphalt removed from the road surface by grinders 14, 15 and 24 on to conveyor 28, which transports the material to the rear end of machine 18. It will thus be understood that at this point, the upper layer of asphalt material 102 has been completely removed from the road surface to a depth of one inch along the path traversed by the equipment train.

A second bank of propane-fired infrared heaters 30 slung beneath machine 18 and capable of being lowered to within a few inches of road surface 100 then heats, to a temperature of about 300° F. and to a depth of about one inch, the lower layer of asphalt 108 exposed by removal of upper asphalt layer 102. A full width grinder assembly 32 at the rear end of machine 18 then removes heated lower asphalt layer 108 from the road surface and windrows the removed material into a pile 110 which is left on top of road surface 100 and centred with respect to grinder 32. Asphalt removed from upper layer 102 and transported along conveyor 28 falls off the end of the conveyor onto pile 110 as depicted by arrow 112 in FIG. 2, thus comingling asphalt removed from upper and lower layers 102, 108 on road surface 100.

Alternatively, grinder 32 may be replaced by a scarifier (not shown) or other assembly which breaks up (i.e. ruptures) heated lower asphalt layer 108, but leaves the broken asphalt in place on road surface 100. In this case, asphalt removed from upper layer 102 and transported along conveyor 28 falls off the end of the conveyor onto the ruptured lower asphalt layer.

Paving machine 38 is driven along road surface 100 behind machine 18. Pick up ramp 34 is attached to the forward end of machine 38 to pick up from road surface 100 the comingled or the ruptured/removed asphalt (as the case may be) and deliver that asphalt to hopper 36. The asphalt is fed from hopper 36 to machine 38, which repaves road surface 100 in conventional fashion, leaving freshly paved surface 200 in its wake.

If desired, and depending upon the extent to which the existing asphalt of road surface 100 has deteriorated, fresh asphalt or an asphalt rejuvenant may be added, in conventional fashion, to the comingled or ruptured/-removed asphalt (as the case may be) prior to delivery thereof to paving machine 38. This is illustrated by means of arrow 114 in FIG. 2.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A method of rejuvenating an asphalt-paved road surface, comprising:

(a) heating an exposed upper layer of said asphalt to a selected temperature and to a depth of approximately one inch;

(b) grinding first and second approximately one inch deep outer strips of said heated upper layer from said road surface;

(c) windrowing asphalt ground from said first and second upper layer outer strips onto a central strip of said heated upper layer to expose first and second lower layer outer strips of said asphalt;

(d) grinding said upper layer central strip from said road surface to a depth of approximately one inch;

(e) removing said windrowed asphalt and said ground upper layer central strip asphalt from said road surface to expose a lower layer central strip of said asphalt;

(f) heating said lower layer to a selected temperature and to a depth of approximately one inch;

(g) rupturing said heated lower layer to a depth of approximately one inch;

(h) replacing said removed asphalt on top of said ruptured lower layer; and then, (i) applying pressure to force said removed/ruptured asphalt against said road surface.

2. A method of rejuvenating an asphalt-paved road surface, comprising:

(a) heating an exposed upper layer of said asphalt to a selected temperature and to a depth of approximately one inch;

(b) grinding first and second approximately one inch deep outer strips of said heated upper layer from said road surface;

(c) windrowing asphalt ground from said first and second upper layer outer strips onto a central strip of said heated upper layer to expose first and second lower layer outer strips of said asphalt;

(d) grinding said upper layer central strip from said road surface to a depth of approximately one inch;

(e) removing said windrowed asphalt and said ground upper layer central strip asphalt from said road surface to expose a lower layer central strip of said asphalt;

(f) heating said lower layer to a selected temperature and to a depth of approximately one inch;

(g) grinding said heated lower layer from said road surface to a depth of approximately one inch;

(h) windrowing asphalt ground from said lower layer onto a central strip of said road surface;

(i) commingling asphalt removed from said upper layer with said windrowed lower layer asphalt; and then, (j) applying pressure to force said commingled asphalt against said road surface.

3. A method as defined in claim 1, further comprising, after said replacing step, adding fresh asphalt or an asphalt rejuvenant to said removed/ruptured asphalt.

4. A method as defined in claim 2, further comprising, after said comingling step, adding fresh asphalt or an asphalt rejuvenant to said comingled asphalt.

5. A method as defined in claim 1, wherein said upper layer is heated to a temperature of about 300° F.

6. A method as defined in claim 5, wherein said lower layer is heated to a temperature of about 300° F.

7. A method as defined in claim 2, wherein said upper layer is heated to a temperature of about 300° F.

8. A method as defined in claim 7, wherein said lower layer is heated to a temperature of about 300° F.

* * * * *